US009931256B2

(12) United States Patent
White et al.

(10) Patent No.: US 9,931,256 B2
(45) Date of Patent: Apr. 3, 2018

(54) SEAT LIFT MECHANISM FOR A RECLINING CHAIR

(71) Applicant: L&P PROPERTY MANAGEMENT COMPANY, South Gate, CA (US)

(72) Inventors: Nikki White, Pontotoc, MS (US); Jeffrey Kyle Plunk, Athens, GA (US)

(73) Assignee: L&P Property Management Company, South Gate, CA (US)

( * ) Notice: Subject to any disclaimer, the term of this patent is extended or adjusted under 35 U.S.C. 154(b) by 272 days.

(21) Appl. No.: 14/723,057

(22) Filed: May 27, 2015

(65) Prior Publication Data

US 2016/0346143 A1 Dec. 1, 2016

(51) Int. Cl.

| | |
|---|---|
| ***A47C 1/029*** | (2006.01) |
| ***A61G 5/14*** | (2006.01) |
| ***A47C 1/034*** | (2006.01) |

(52) U.S. Cl.

CPC ..... *A61G 5/14* (2013.01); *A47C 1/029* (2013.01); *A47C 1/0345* (2013.01)

(58) Field of Classification Search

CPC ..... A47C 1/028; A47C 1/029; A47C 3/30; A47G 5/14

See application file for complete search history.

(56) References Cited

U.S. PATENT DOCUMENTS

| | | | | |
|---|---|---|---|---|
| 4,573,736 | A * | 3/1986 | Levenberg | A61G 5/14 297/337 |
| 4,690,457 | A | 9/1987 | Poncy et al. | |
| 5,312,153 | A * | 5/1994 | Lin | A47C 1/0345 297/68 |
| 5,513,867 | A * | 5/1996 | Bloswick | A61G 5/14 280/250.1 |
| 6,213,554 | B1 | 4/2001 | Marcoux et al. | |
| 6,533,353 | B2 | 3/2003 | Johnston | |
| 7,455,360 | B2 * | 11/2008 | White | A47C 1/029 297/321 |
| 8,915,544 | B2 | 12/2014 | LaPointe | |
| 2001/0035668 | A1 * | 11/2001 | Gaffney | A47C 1/0345 297/85 M |
| 2005/0227826 | A1 * | 10/2005 | Oga | A63B 23/0405 482/92 |
| 2007/0227787 | A1 * | 10/2007 | Kuramoto | A61G 5/045 180/65.1 |
| 2007/0278761 | A1 * | 12/2007 | Firth | A61G 5/1054 280/250.1 |
| 2009/0315376 | A1 * | 12/2009 | Nishiwaki | A61G 5/006 297/301.2 |
| 2015/0076891 | A1 * | 3/2015 | LaPointe | A47C 31/008 297/85 M |
| 2015/0282619 | A1 * | 10/2015 | Lawson | A47C 1/0355 297/83 |

* cited by examiner

*Primary Examiner* — Timothy J Brindley
(74) *Attorney, Agent, or Firm* — Shook, Hardy & Bacon L.L.P.

(57) ABSTRACT

A lift mechanism for a reclining chair is provided. The lift mechanism can include a lock that prevents the seat from shifting from a reclining position into a seat-lift position without first shifting into an upright, closed position. The lock is shiftable between a locked position, where the chair is prevented from shifting into a seat-lift position and an unlocked position where the chair is permitted to shift into a seat-lift position. The lift mechanism can include an activator tube that can shift the lock between the unlocked and locked positions.

17 Claims, 13 Drawing Sheets

SEAT LIFT MECHANISM FOR A RECLINING CHAIR

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

Aspects of this disclosure relate to chair lift mechanisms. More particularly, this disclosure includes embodiments relating to a lift mechanism for reclining chairs that includes a lock that can ensure the chair is in an upright, closed position prior to lifting the chair.

BACKGROUND

Various reclining chairs can include a lift mechanism to aid in moving a user into a standing position when getting out of the chair. However, in certain chairs, a large amount of weight applied to the chair back can prevent the chair from rotating up to a closed position when the lift mechanism is activated. In this situation, the force of the lift mechanism lifts the chair while it is still partially reclined, which can cause the lift mechanism to malfunction and cause the chair to drop back into an upright, closed position. What is needed is a lift mechanism that can ensure that the chair is in an upright, closed position prior to lifting the chair.

BRIEF SUMMARY

The present disclosure generally relates to lift mechanisms that can ensure that a seating unit, e.g., a chair, is in an upright position prior to activating the lift action of the lift mechanism. The lift mechanism disclosed herein can include a lock that shifts between a locked position, where the lift action of the lift mechanism will not activate, and an unlocked position, where the lift action of the lift mechanism is activated. In embodiments, an activator tube can, at least partly, aid in shifting the lock between the locked and unlocked positions.

Accordingly, in one embodiment, a lift mechanism for a seating unit is provided. The lift mechanism includes a lift activator assembly configured to shift a seating unit between a closed position and a seat-lift position. The lift activator assembly includes an activator tube. The lift mechanism further includes a lock configured to shift between a locked position, where the seating unit is prevented from shifting into the seat-lift position, and an unlocked position, where the seating unit is permitted to shift into the seat-lift position. The activator tube is configured to shift the lock from the locked position to the unlocked position.

In another embodiment, a lift mechanism for a seating unit is provided. The lift mechanism includes a lift activator assembly configured to shift a seating unit between a closed position and a seat-lift position. The lift activator assembly includes an extendable activator member and an activator tube. The lift mechanism also includes a lock configured to pivotably shift between a locked position, where the seating unit is prevented from shifting into the seat-lift position, and an unlocked position, where the seating unit is permitted to shift into the seat-lift position. The extendable activator member is configured to extend outward toward the front of the seating unit, and the activator tube is configured to shift the lock from the locked position to the unlocked position as the extendable activator member extends outward toward the front of the seating unit.

In yet another embodiment, a lift chair is provided, which includes a seat, a seat back, and a lift activator assembly configured to shift a chair between a closed position and a seat-lift position. The lift activator assembly includes an activator tube. The lift chair further includes a lock configured to shift between a locked position, where the seating unit is prevented from shifting into the seat-lift position, and an unlocked position, where the seating unit is permitted to shift into the seat-lift position. The activator tube is configured to shift the lock from the locked position to the unlocked position.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies.

For purposes of this disclosure, the word "including" has the same broad meaning as the word "comprising." In addition, words such as "a" and "an," unless otherwise indicated to the contrary, include the plural as well as the singular. Thus, for example the requirement of "a feature" is satisfied where one or more features are present. Also, the term "or" includes the conjunctive, the disjunctive and both (a or b thus includes either a or b, as well as a and b).

Figure 1:
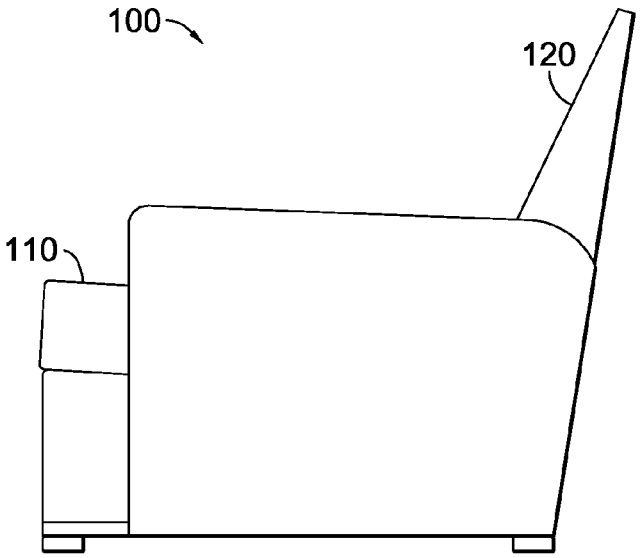
FIG. 1 is a side view of a schematic representation of a reclining chair having a lift mechanism, particularly illustrating the chair in an upright, closed position, in accordance with an embodiment of the present invention.
Figure 2:
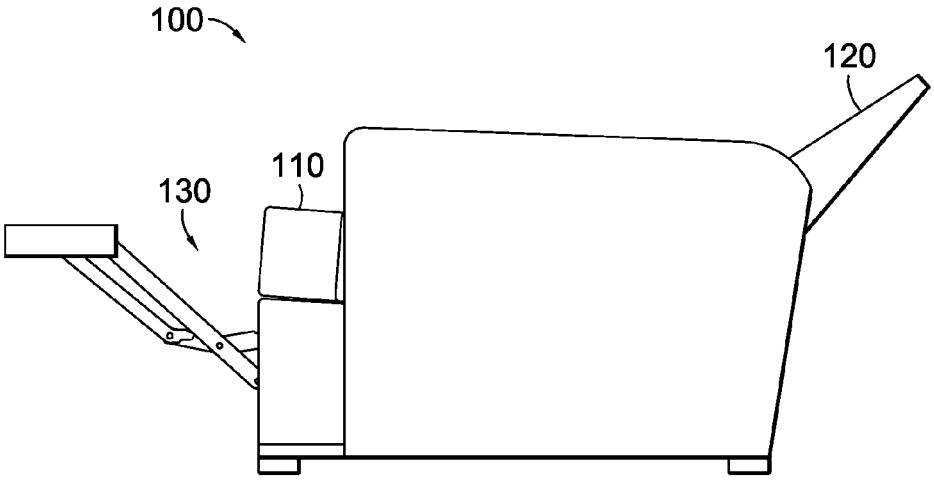
FIG. 2 a side view of the reclining chair of FIG. 1 in a reclined position, in accordance with an embodiment of the present invention.
Figure 3:
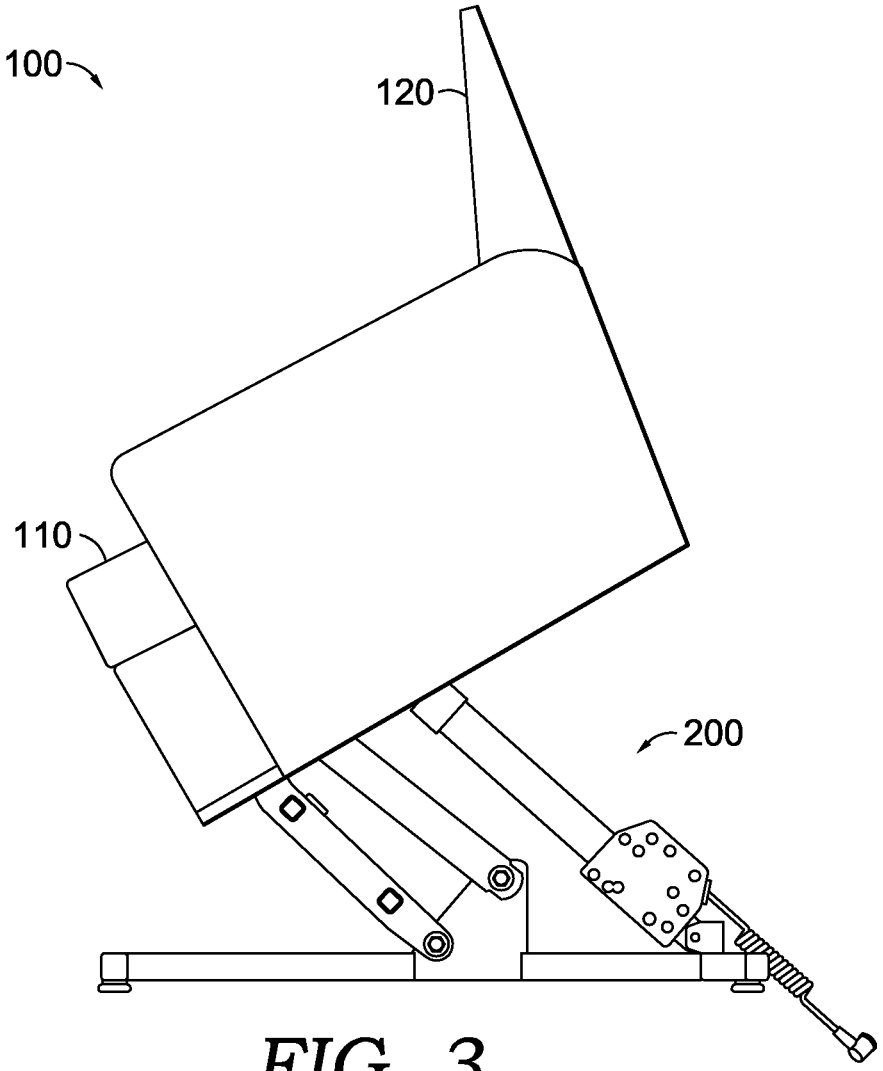
FIG. 3 a side view of the reclining chair of FIG. 1 in a seat-lift position, in accordance with an embodiment of the present invention.

Turning now to the figures, FIGS. 1-3 depict a reclining chair 100. It should be understood that the reclining chair 100 depicted in FIGS. 1-3 is provided for demonstrative purposes only, and thus, the present invention may be employed with any type of reclining lift chair. The chair 100 includes a seat 110, a seat back 120, a reclining mechanism 130, and a lift mechanism 200.

As can be seen in FIGS. 1 and 2, the chair 100 is adjustable and can shift between an upright, closed position, as depicted in FIG. 1, and a fully reclined position, as depicted in FIG. 2. Although not shown in the figures, the chair 100 can also be shifted into a "TV" position, where the footrest of the chair 100 is fully extended but the seat back 120 is only partially reclined. In embodiments, the chair 100 can shift from an upright, closed position, to a TV position, and then into a fully reclined position. It is appreciated by one skilled in the art that the lift mechanism disclosed herein may be utilized with a number of different chairs and chair-types. One skilled in the art also appreciates that the lift mechanism 200 disclosed herein may be utilized with a variety of different reclining mechanisms 130.

FIG. 3 depicts the chair 100 in the seat-lift position, where the lift mechanism 200 has tilted and lifted at least the seat 110 and the seat back 120 to facilitate moving a user from a seated position to a standing position. As will be discussed in detail below, the lift mechanism 200 ensures that the seat is in a closed, upright position prior to lifting the chair.

In various embodiments, the lift mechanisms disclosed herein, e.g., the lift mechanism 200, includes a lock to ensure that the chair is in an upright, closed position prior to lifting the chair into a seat-lift position. Accordingly, in various embodiments, when the chair 100 is in a fully reclined position, such as that depicted in FIG. 2, a lock associated with the lift mechanism 200 prevents the chair from shifting from a reclined position into a seat-lift position, without first shifting from the reclined position to the upright, closed position.

Figure 4:
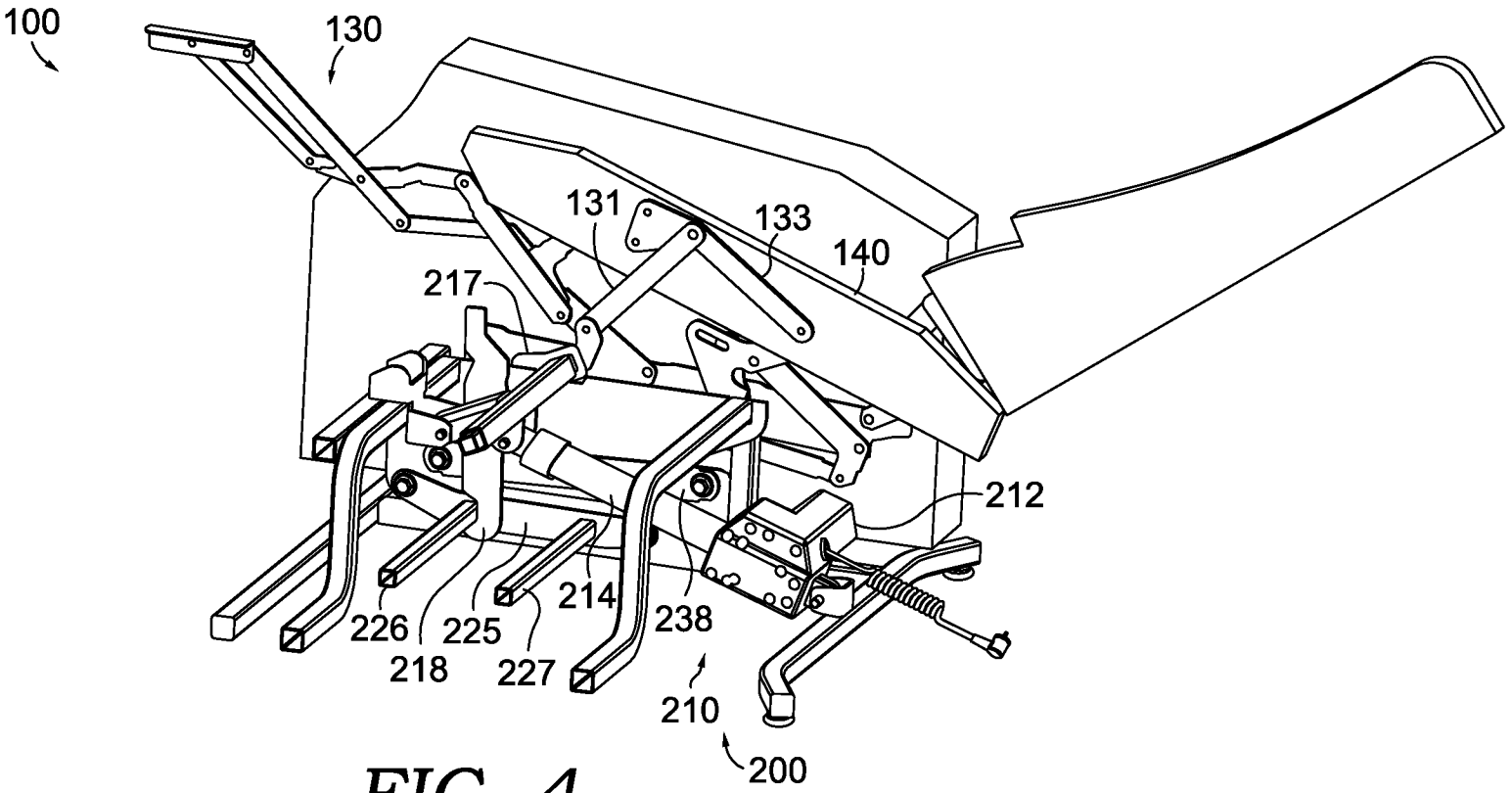
FIG. 4 is a perspective view of a chair in a reclined position having portions of the seat back and seat removed, and particularly showing the reclining mechanism and the lift mechanism, where the lock of the lift mechanism is in the locked position, in accordance with an embodiment of the present invention.
Figure 5:
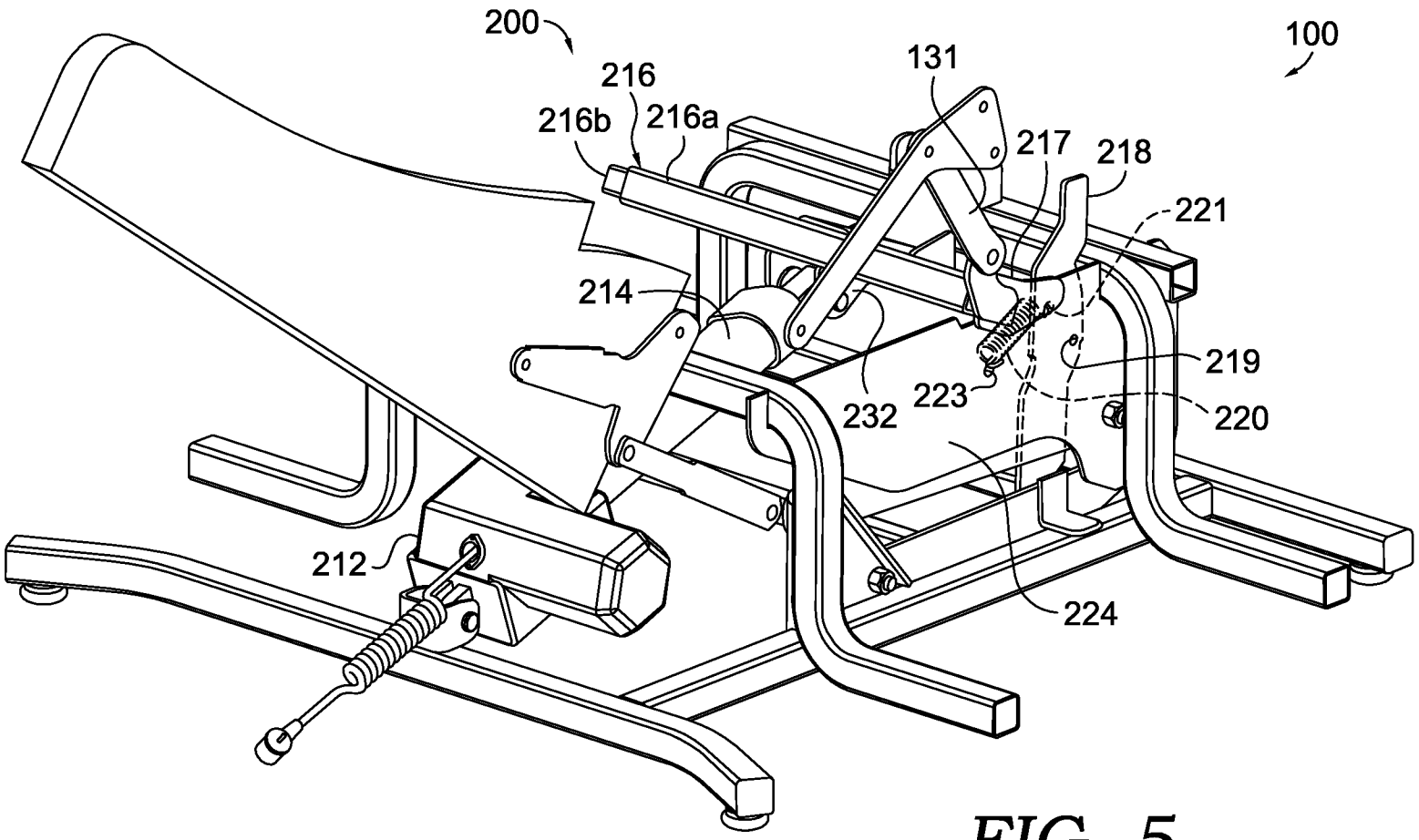
FIG. 5 is another perspective view of the chair of FIG. 4 with additional chair portions removed, in accordance with an embodiment of the present invention.

FIGS. 4 and 5 depict a chair 100 in a fully reclined position. In FIGS. 4 and 5, portions of the chair 100 have been removed to reveal the reclining mechanism 130 and the lift mechanism 200. It is to be understood that, unless otherwise noted herein, the components of the lift mechanism 200 and/or the reclining mechanism 130 described herein may be fabricated from metal stock (e.g., formed sheet metal). However, it should also be understood and appreciated that any suitable rigid or sturdy material known in the furniture-manufacturing industry may be used in place of the aforementioned materials.

As discussed above, the lift mechanism 200 includes a lock 218 that prevents the chair 100 from shifting into a seat-lift position from a reclined position without first shifting into an upright, closed position. As best seen in FIG. 5, the lock 218 can be coupled to the side lift plate 224. In such embodiments, the lock 218 can be pivotably coupled to the side lift plate 224 at a lock connection point 219. In embodiments, a biasing member 220, e.g., a spring, may be coupled to the lock 218 at a connection point 221, and to the side lift plate 224 at a connection point 223. In such embodiments, the biasing member 220 can apply a force to the lock 218 such that the lock 218 maintains engagement with a front cross member 226 extending out from a lower riser bar 225. This engagement of the lock 218 with the cross member 226 prevents movement of the lift mechanism 200. As described below, the lock 218 is only moved out of engagement with the cross member 226 when the chair 100 is moved to a closed position, allowing the lift mechanism 200 to lift.

In certain embodiments, a rear cross member 227 can also extend out from the lower riser bar 225. While not depicted in FIGS. 4 and 5, the lift mechanism 200 can include another lower riser bar coupled to the other ends of the front and rear cross members 226 and 227, respectively. In addition, an upper riser bar 238 can be positioned above the lower riser bar 225, which may also occur on the opposing side of the cross members 226 and 227.

The lift mechanism 200 can also include a lift activator assembly 210. In embodiments, the lift activator assembly 210 can include an extendable activator member 214 and a motor 212 to apply a force to extend and retract the extendable activator member 214. The motor or linear actuator 212 can be any type known to be commonly used in the furniture manufacturing industry and a particular linear actuator or motor can be chosen by one skilled in the art for a particular purpose. In addition, one skilled in the art would appreciate that not all portions or perhaps no portions of the motor 212 and/or extendable activator assembly 214 may be fabricated from metal stock.

Figure 9:
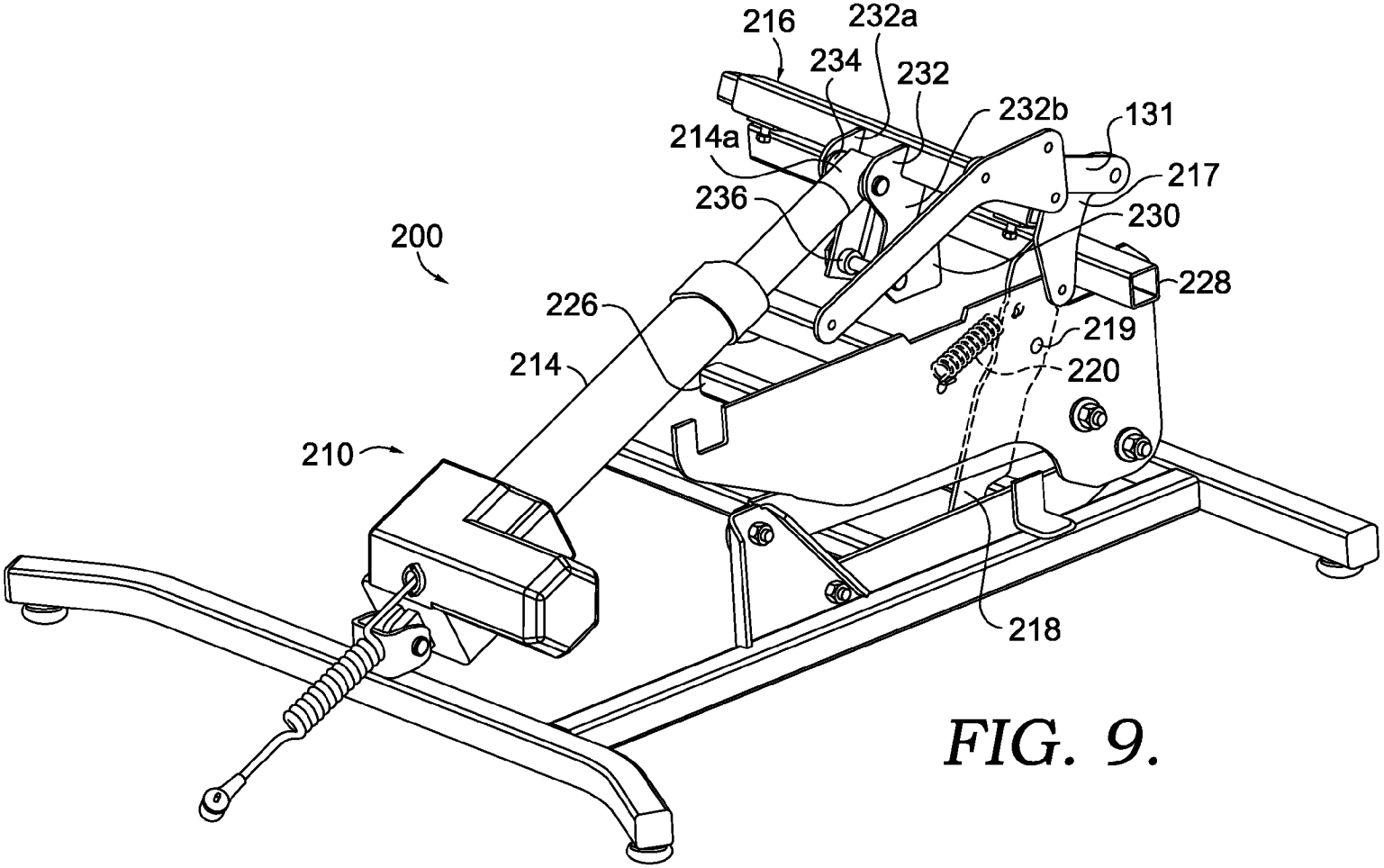
FIG. 9 is a perspective view of the lift mechanism of the chair in FIG. 7, in accordance with an embodiment of the present invention.

In embodiments, as best seen in FIGS. 5 and 9, an activator tube 216 can be connected to the extendable activator member 214 via a swing link 232. In one or more embodiments, such as that depicted in FIG. 5, the activator tube 216 may include an inner activator tube **216*b* positioned inside an outer activator tube 216*a*. In such embodiments, this configuration of the activator tube 216 may allow for easier assembly of the lift mechanism 200 and/or provide additional support to the activator tube 216. In certain other embodiments, the activator tube 216 may be a single tube. As used herein, the term activator tube 216 refers to both an embodiment where there is an inner activator tube 216*b* positioned inside of an outer activator tube 216*a* (such as that depicted in FIG. 5), and to an embodiment where the activator tube 216** is a single tube.

The activator tube 216 can be fixedly coupled to an activator tube bracket 217. Further, as can be seen in FIGS. 4 and 5, the activator tube bracket 217 is coupled to a drive link 131, which can initiate the movement of the reclining mechanism 130 between a reclined position and an upright, closed position. Movement of the activator tube 216 causes rotation of the activator tube bracket 217, which in turn moves the drive link 131, in order to initiate the movement of the reclining mechanism 130. As can be seen in FIG. 4, the drive link 131 is pivotably coupled to an attachment link 133. The attachment link 133 is fixedly coupled to the side support member 140. Thus, the movement of the drive link 131 causes the movement of the attachment link 133 and the side support member 140, which initiates the reclining mechanism 130 to shift the chair 100 between a reclined position and an upright, closed position. It should be understood that, while only depicted singularly in FIGS. 4 and 5, another activator tube bracket, drive link, attachment link, side support member, and reclining mechanism may be present on the opposite end of the activator tube 216 in a mirror image configuration to that depicted in FIGS. 4 and 5. Further, in certain embodiments, another lock, biasing member, and/or side lift plate may also be included on the opposite side of the lift mechanism 200 in a mirror image configuration to that depicted in FIGS. 4 and 5.

As discussed above, the activator tube 216, and the activator tube bracket 217, can shift the lock 218 between an unlocked and locked position. Since the activator tube bracket 217 is coupled to the drive link 131, the movement of the activator tube bracket 217, and activator tube 216, can simultaneously affect the position of the lock 218 and the position of the reclining mechanism 130 (via the position of the drive link 131). Accordingly, in the lift mechanism 200 depicted in FIGS. 4 and 5, the position of the activator tube 216 and the activator tube bracket 217 ensure that, when the chair 100 is in a reclined position, the lock 218 is in a locked position (and thus the chair 100 cannot shift into a seat-lift position), and when the chair is in an upright, closed position, the lock 218 is in an unlocked position (and thus the chair 100 can shift into the seat-lift position).

When the chair 100 is in the reclined position, as depicted in FIGS. 4 and 5, the lift activator assembly 210 is in a retracted position. For example, in such embodiments, the extendable activator member 214 is retracted and the activator tube 216 is not engaged with the lock 218; rather, the activator tube 216 is spaced apart from and not in contact with the lock 218. In this reclined position, the force of the biasing member 220 on the lock 218 maintains the lock 218 engaged with the cross member 226. Further, this position of the activator tube 216, and the position of the activator tube bracket 217, maintains the drive link 131 in a position, e.g., a relatively vertical position, that maintains the chair 100 in a reclined position.

Figure 10:
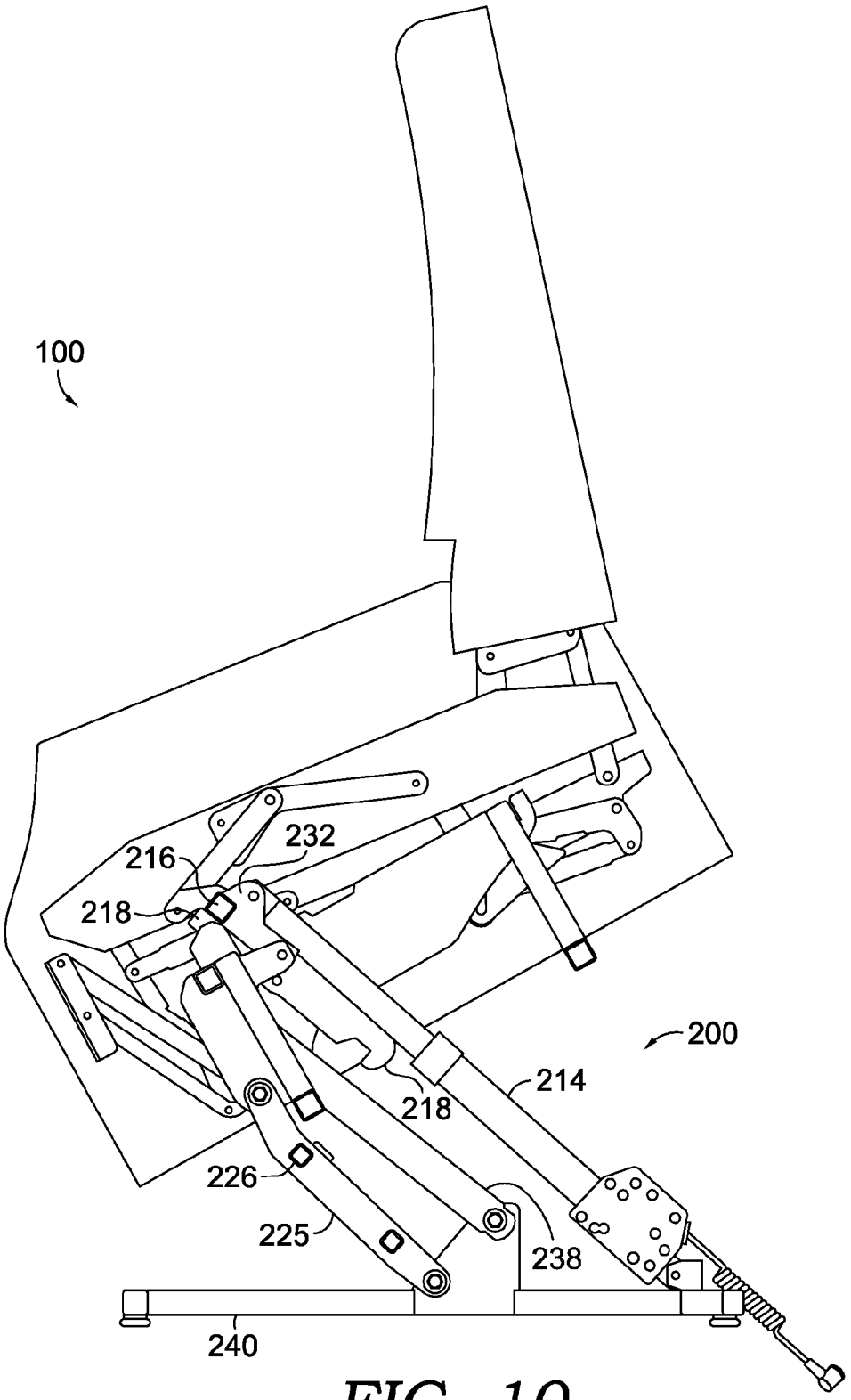
FIG. 10 is a side view of a chair in a seat-lift position having outer portions of the chair removed, and particularly showing an extendable activator member in an extended position, and the upper and lower riser bars extended upward away from the base, in accordance with an embodiment of the present invention.
Figure 11:
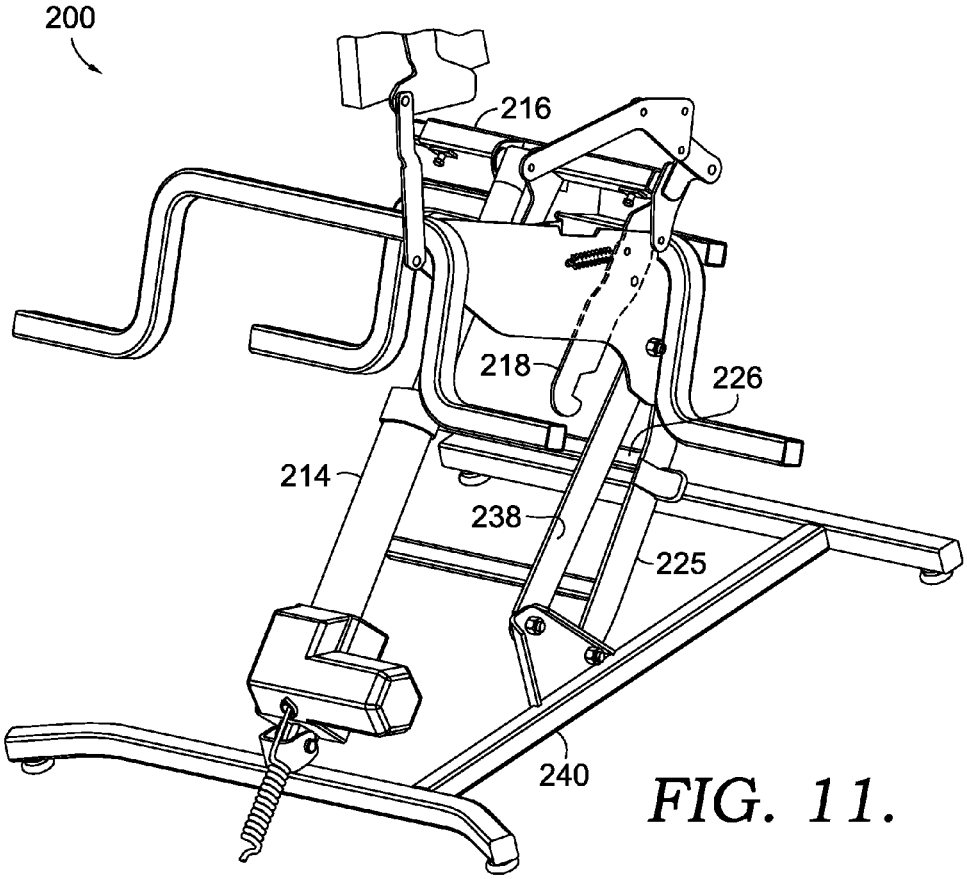
FIG. 11 is a perspective view of the chair in FIG. 10, shown with additional portions of the chair removed, in accordance with an embodiment of the present invention.

As discussed further below, when the chair 100 is shifting from a reclined position into an upright, closed position, the activator tube 216 moves to a point where it engages the lock 218. At this point, the chair 100 is in between the fully reclined position and the upright, closed position. As the chair 100 continues to shift into the upright, closed position, the activator tube 216 continues to rotate outward towards the front of the chair 100, thereby moving the lock 218 such that the lock 218 is no longer engaged with the cross member 226, and thus, permitting the lift mechanism 200 to lift the chair 100 into a seat-lift position. Below, the lift mechanism 200 will be described in detail with respect to when the chair 100 is in a position between the fully reclined and the upright, closed position (FIG. 6), when the chair 100 is in the upright, closed position (FIGS. 7-9), and when the chair 100 is in the seat-lift position (FIGS. 10 and 11).

Figure 6:
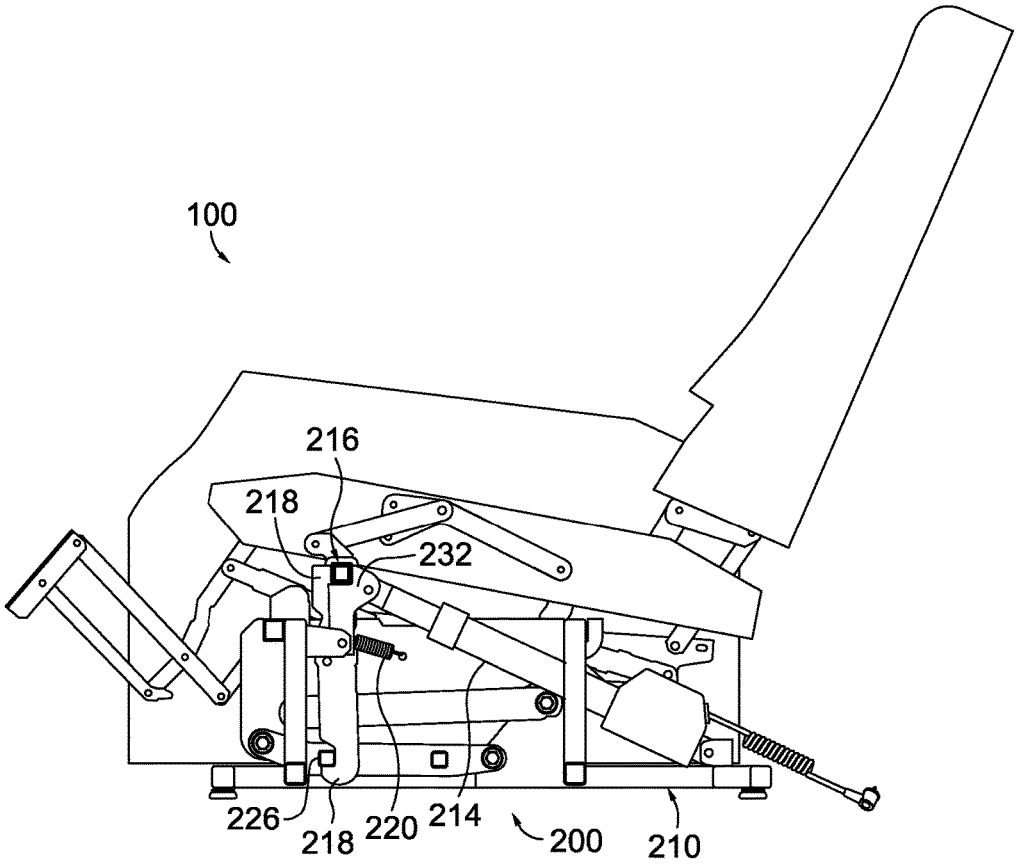
FIG. 6 is a side view of a chair in a partially upright position having outer portions of the chair removed, and particularly showing the lock in a locked position and the activator tube engaging an upper portion of the lock, in accordance with an embodiment of the present invention.

Turning now to FIG. 6, which depicts the chair 100 and the reclining mechanism 130 in a position between a fully reclined position and an upright, closed position (i.e., a semi-closed position). In this semi-closed position, the extendable activator member 214 is partly extended out towards the front of the chair 100, and the activator tube 216 has rotated, via the swing link 232, up and forward towards the front of the chair 100 to a point where the activator tube 216 has engaged a portion of the lock 218. In this semi-closed position depicted in FIG. 6, the lock 218 maintains engagement with the cross member 226, since the activator tube 216 has not rotated forward enough so as to apply enough force on the lock 218 to overcome the biasing force on the lock 218 by the biasing member 220 and pivot the lock 218 away from the cross member 226.

Figure 7:
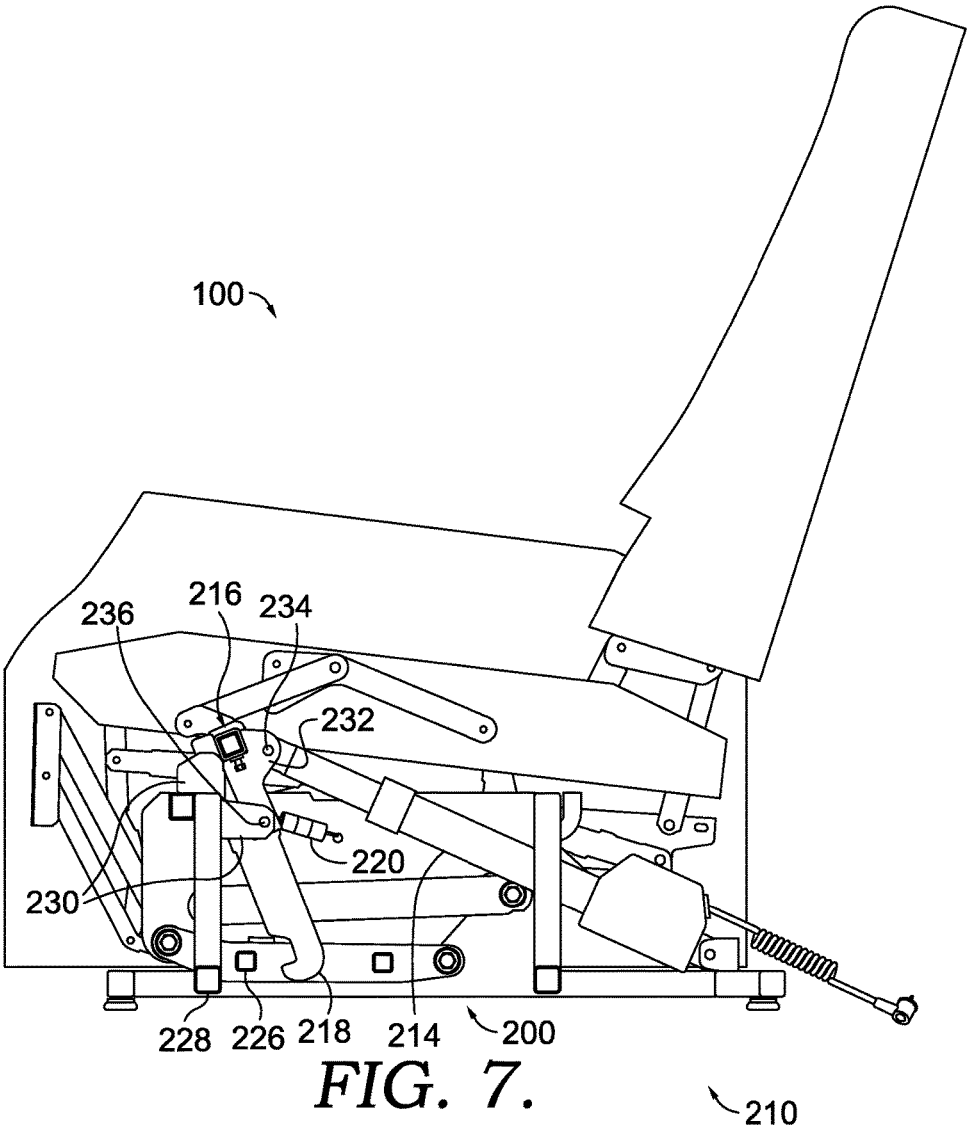
FIG. 7 is a side view of a chair in an upright, closed position having outer portions of the chair removed, and particularly showing the lock in an unlocked position and the activator tube engaging an upper portion of the lock, in accordance with an embodiment of the present invention.
Figure 8:
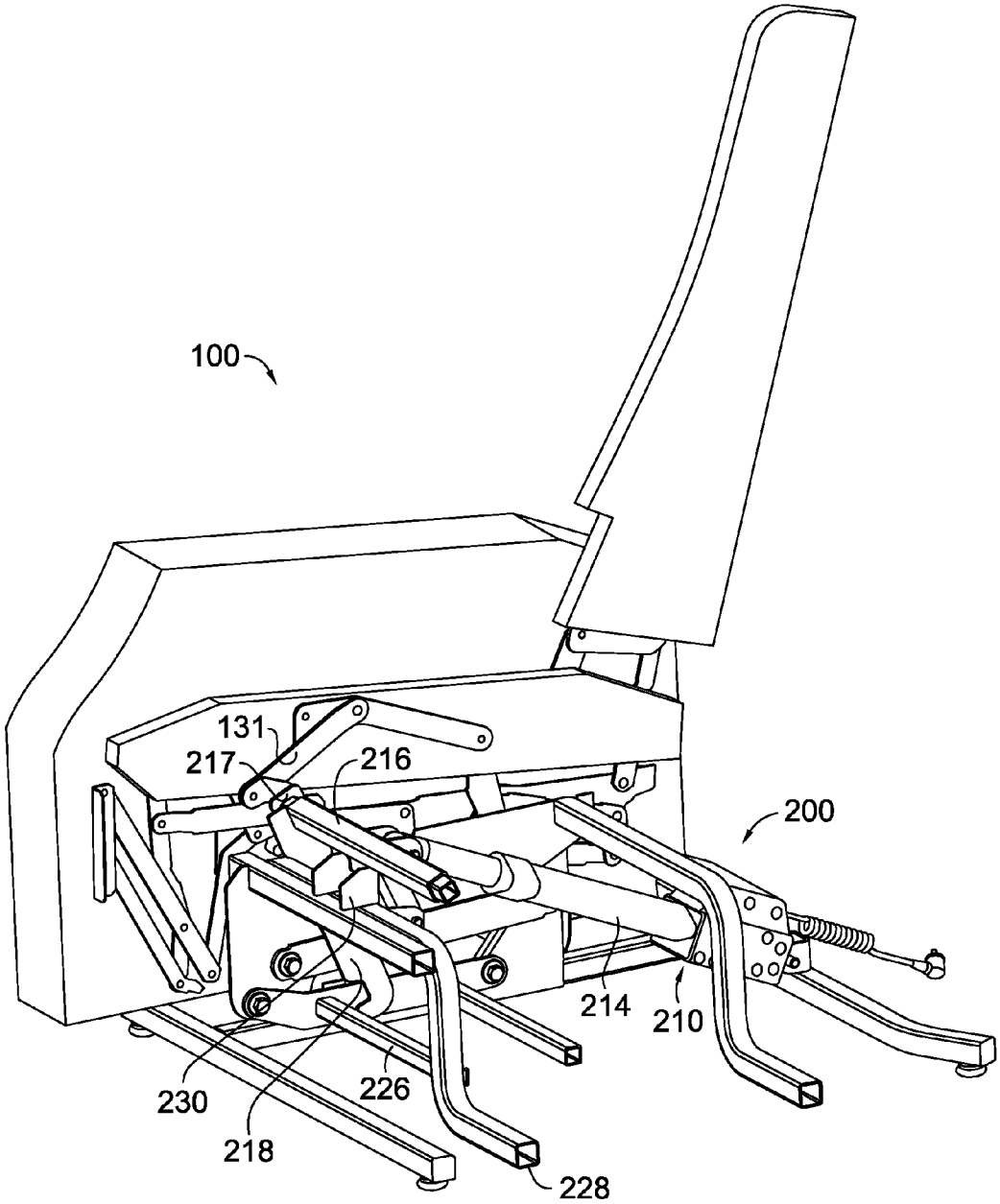
FIG. 8 is a perspective view of the chair in FIG. 7, in accordance with an embodiment of the present invention.

FIGS. 7-9 depict the chair 100 in the upright, closed position, where the lock 218 is disengaged from the cross member 226. In embodiments, to disengage the lock 218 from the cross member 226, the activator tube 216 can transmit a force to a portion of the lock 218 to overcome the biasing force that maintains the lock 218 engaged with the cross member 226. For example, in such embodiments, the activator tube 216 can transmit enough force to a portion of the lock 218 so that the lock 218 pivots about the lock connection point 219 away from the cross member 226. Further, in such embodiments, this force can be supplied by the continued outward extension of the extendable activator member 214 and the associated rotation of the activator tube 216. Additionally, this rotation of the activator tube 216, and rotation of the activator tube bracket 217, is associated with the shifting of the drive link 131 to a position, e.g., a relatively horizontal position, that can maintain the chair 100 in an upright, closed position.

The structures and assemblies of the lift mechanism 200 that can be involved in moving the activator bar 216 to a position that can cause the lock 218 to shift to an unlocked position are best illustrated in FIG. 9. As discussed above, the extendable activator member 214 of the lift activation assembly 210 is coupled to a swing link 232. In certain embodiments, the swing link 232 can include two swing link portions 232*a* and 232*b* positioned on either side of an end 214*a*, or adjacent to the end 214*a*, of the extendable activator member 214. In such embodiments, the two swing link portions 232*a* and 232*b* can be connected to the end 214*a* of the extendable activator member 214 via a pin 234. The pin 234 can be any object capable of securing the swing link portions 232*a* and 232*b* to the end 214*a* of the extendable activator member 214 such that at least a portion of the swing link 232 can pivot about the pin 234.

As depicted in FIG. 9, the two swing link portions 232*a* and 232*b* can also be coupled to a lift tube bracket 230 that is fixedly coupled to a front lift tube 228. The two swing link portions 232*a* and 232*b* can be pivotably coupled to the lift tube bracket 230, e.g., via a pin 236. As best seen in FIGS. 7 and 8, when the chair 100 is in the upright, closed position, the activator tube 216 has rotated to a point to engage the upper portion of the lift tube bracket 230 that rests on top of the lift tube 228. From this position, the extendable activator member 214 can continue to extend outward which can cause the lift mechanism 200 to begin to lift the chair 100 into a seat-lift position, as depicted in FIGS. 10 and 11.

As seen in the chair 100 depicted in FIGS. 10 and 11, the extendable activator member 214 has extended to a point where the chair 100 is in a seat-lift position. In embodiments, as the extendable activator member 214 extends into this seat-lift position, a lower riser bar 225 and an upper riser bar 238 can extend outward toward the front of the chair 100 and upward away from the base 240. In addition, in this seat-lift position, the activator tube 216 and swing link 232 are positioned so as to maintain contact with a portion of the lock 218. Further, in this seat-lift position, the lock 218 is incapable of engaging the cross member 226, due to the increased distance between these components caused by the lifting of the chair 100.

In certain embodiments, the lock for the lift mechanisms disclosed herein can be positioned and/or structured different than the lock 218 of the lift mechanism 200 discussed above with reference to FIGS. 4-11. For example, FIGS. 12 and 13 depict a chair 300 with a lift mechanism 400 that includes a lock 418 positioned within the lift mechanism 400 differently than the position of the lock 218 within the lift mechanism 200 of FIGS. 4-11.

Figure 12:
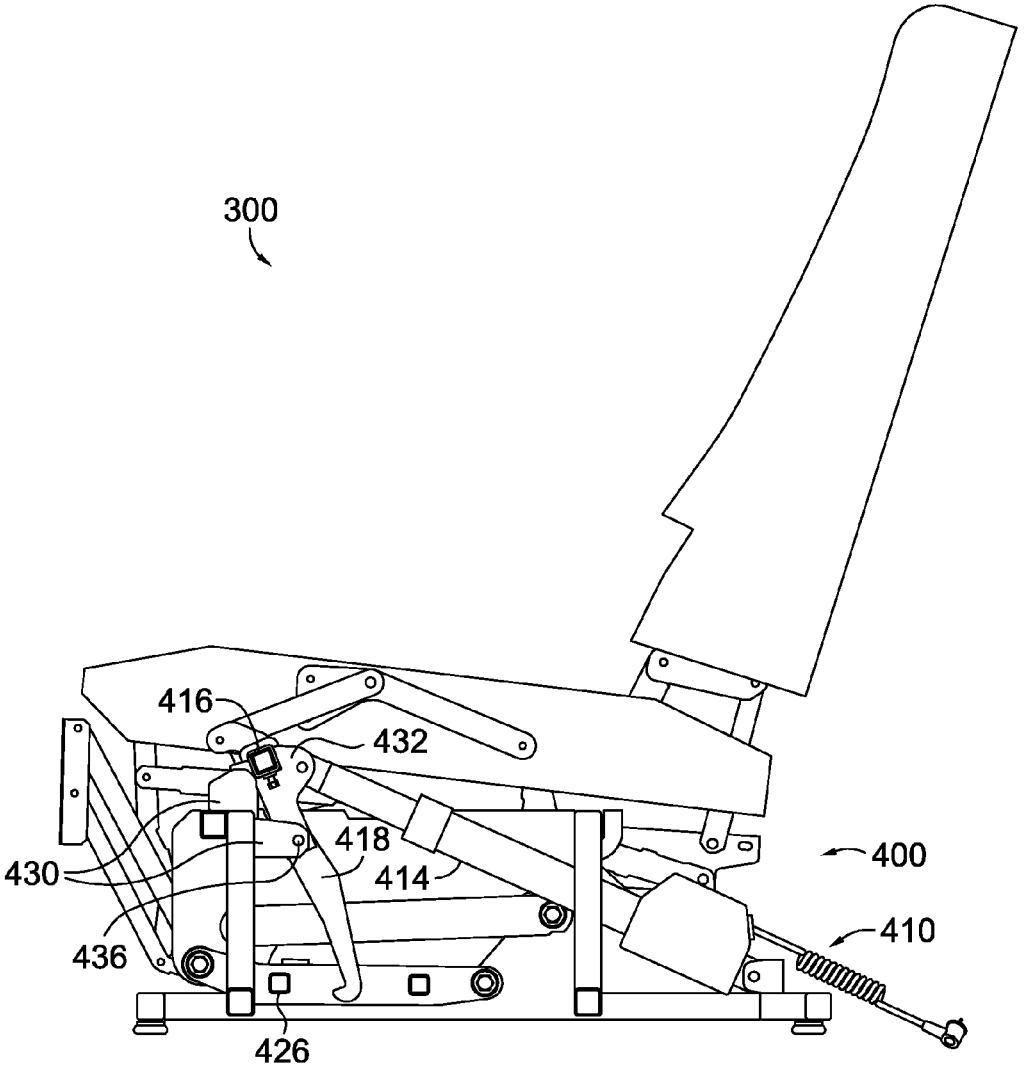
FIG. 12 is a side view of a chair in an upright, closed position having outer portions of the chair removed, and particularly showing the lock in an unlocked position and the activator tube engaging an upper portion of the lock, in accordance with an embodiment of the present invention.
Figure 13:
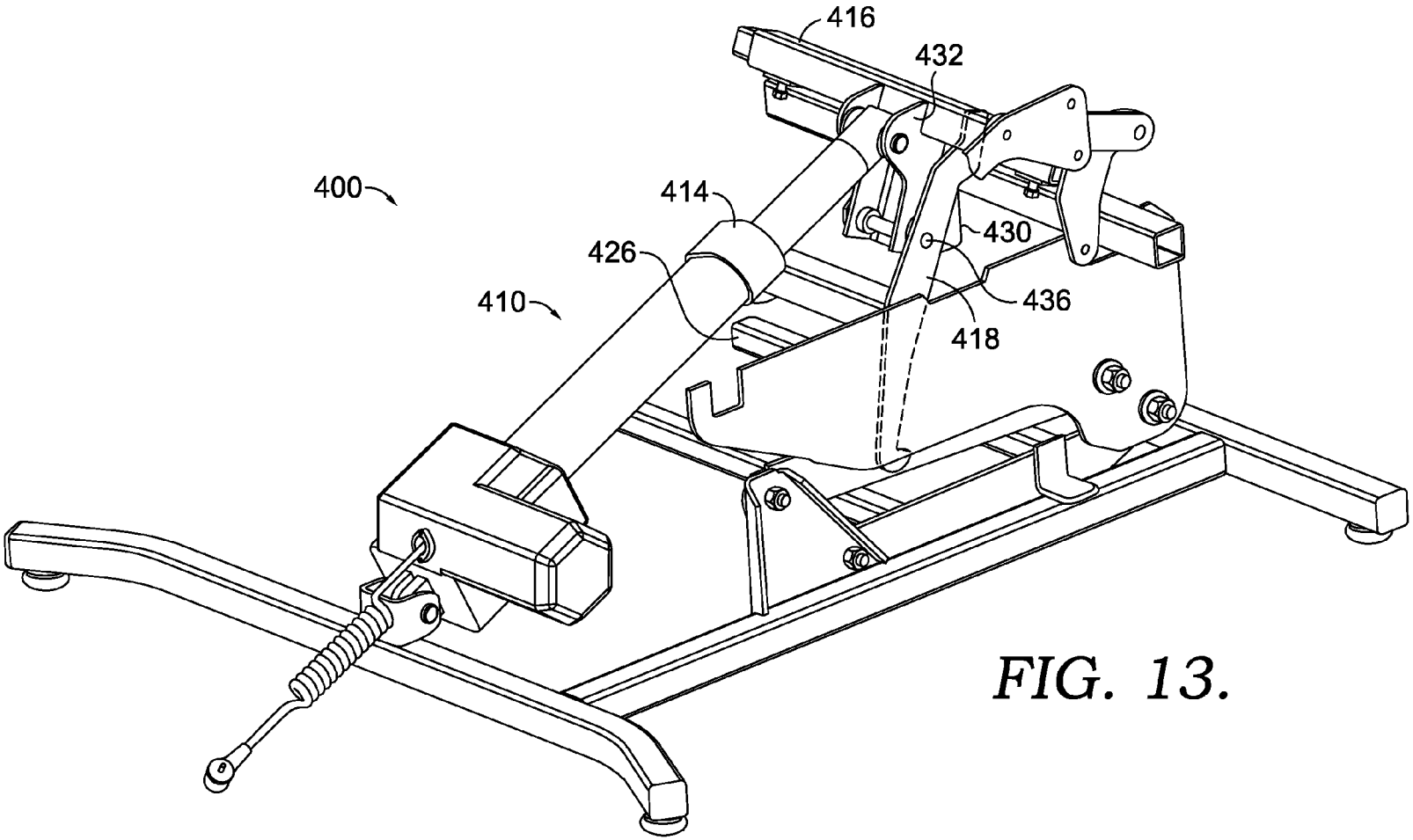
FIG. 13 is a perspective view of the lift mechanism of the chair in FIG. 12, particularly showing the lock coupled to the swing link of the lift activator assembly, in accordance with an embodiment of the present invention.

The lift mechanism 400 depicted in FIGS. 12 and 13 includes a lock 418, which can be coupled to the swing link 432 and lift tube bracket 430 via the pin 436. In this embodiment, the pin 436 is utilized to couple the swing link 432, the lift tube bracket 430, and the lock 418 together such that a portion of the lift tube bracket 430 is positioned between the lock 418 and a portion of the swing link 432. In embodiments, the lift tube bracket 430 and the swing link 432 can have the same properties as the lift tube bracket 230 and swing link 232 discussed above with reference to FIGS. 4-11.

In operation, like the lock 218 discussed above with reference to the lift mechanism 200 depicted in FIGS. 4-11, the lock 418 can engage a cross member 426 when in the locked position and disengage the cross member 426 when in the unlocked position. For example, the chair 300 depicted in FIG. 12 is in an upright, closed position and the lock 418 is disengaged from the cross member 426. Additionally, the extendable activator member 414 of the lift activator assembly 410 is extended to a position where the activator tube 416 is contacting a portion of the lock 418, thereby applying a force sufficient to pivot the lock 418 away so as to disengage from the cross member 426. This unlocked and disengaged position of the lock 418 allows the lift mechanism 400 to lift the chair 300 into a seat-lift position. When the chair 300 is in a semi-closed position or a reclined position, the lock 418 is structured such that it will engage the cross member 426. That is, when the chair 300 is in the semi-closed position or the reclined position, the activator tube 416 will not be engaged with the lock 418, allowing the lock 418 to pivot about the pin 436 and engage the cross member 426. In embodiments, the cross member 426, the extendable activator member 414, and the activator tube 416 can have the same properties as the cross member 226, the extendable activator member 214, and the activator tube 216 discussed above with reference to the lift mechanism 200 depicted in FIGS. 4-11.

Figure 14:
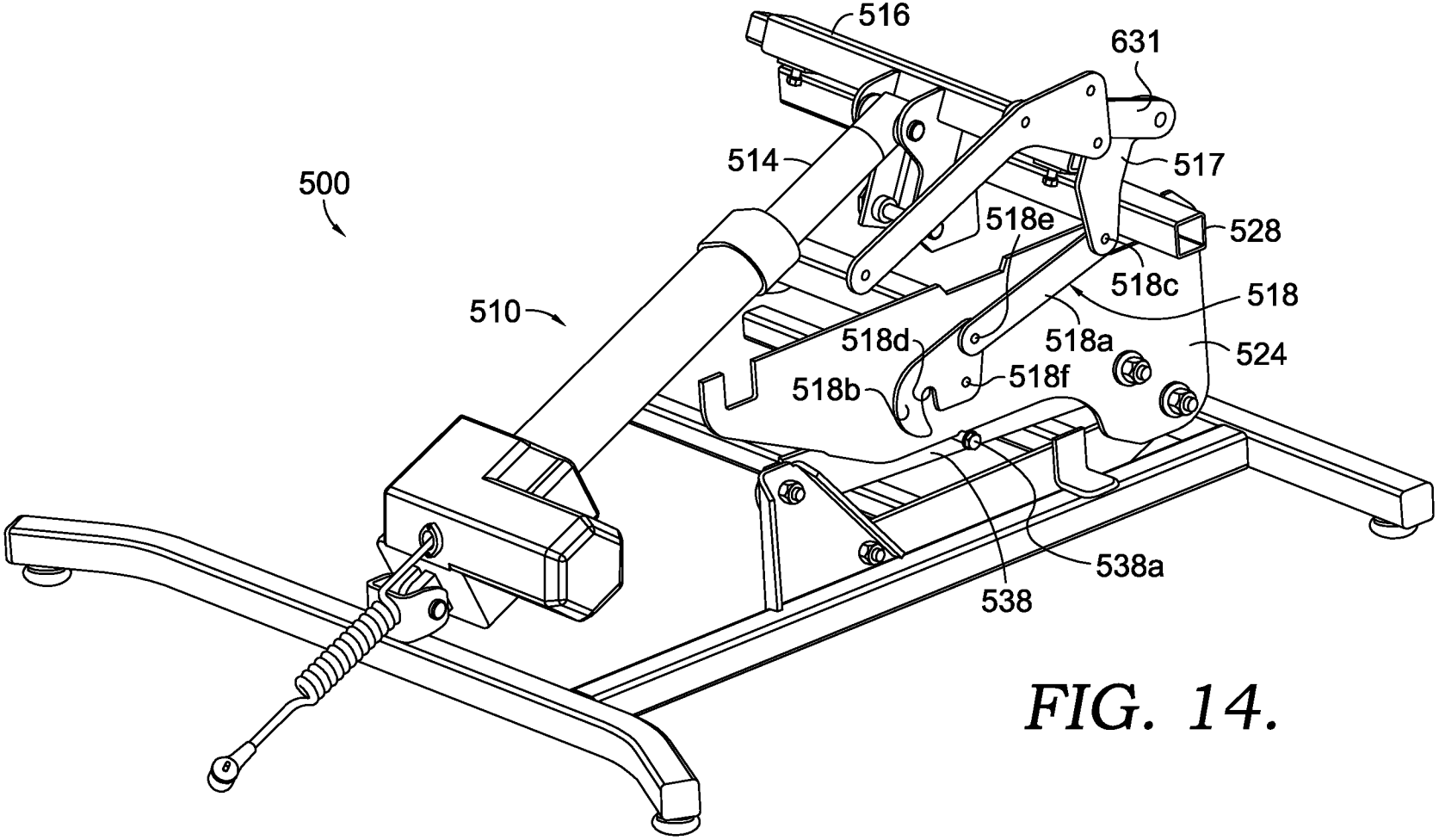
FIG. 14 is a perspective view of a lift mechanism for a chair, particularly showing a lock in an unlocked position, where the lock is coupled to the activator tube bracket, in accordance with an embodiment of the present invention.

FIG. 14 depicts another lock 518 that is structured and positioned different than the lock 218 of the lift mechanism 200 of FIGS. 4-11. Like the lock 218, the lock 518 of the lift mechanism 500 depicted in FIG. 14 can prevent a chair from shifting from a reclined position to a seat-lift position without first shifting into a upright, closed position. In embodiments, with the exception of the lock 518, the lift mechanism 500 can include the same or similar functioning components as those discussed above with reference to the lift mechanism 200 depicted in FIGS. 4-11. For example, the lift activator assembly 510, the extendable activator arm 514, the activator tube 516, the activator tube bracket 517, the side lift plate 524, and the upper riser bar 538 can have the same properties as the lift activator assembly 210, the extendable activator arm 214, the activator tube 216, the activator tube bracket 217, the side lift plate 224, and the upper riser bar 238 discussed above with reference to the lift mechanism 200 depicted in FIGS. 4-11.

The lock 518 depicted in FIG. 14 is coupled to the activator tube bracket 517 at the lock connection point 518*c*, and is positioned on the outside of the side lift plate 524. The lock 518 depicted in FIG. 14 includes two separate links 518*a* and 518*b* that are pivotably coupled to one another at connection point 518*e*. In the embodiment depicted in FIG. 14, the link 518*b* is also pivotably coupled to the side lift plate 524 at connection point 518*f*. It is appreciated that the lock 518 can be one integral piece, or can include more than two separate pieces connected together. In embodiments, the lock 518 is configured to engage an engagement member 538*a* coupled to the upper riser bar 538. For example, the lock 518 includes a slot 518*d* to engage the member 538*a* when the lock 518 pivots downward, e.g., when the link 518*b* pivots about connection point 518*f*.

In the embodiment depicted in FIG. 14, the lock 518 is in an unlocked position, e.g., disengaged from the member 538*a*. Further, in the embodiment depicted in FIG. 14, the extendable activator member 514 is extended outward, and the activator tube 516 and activator tube bracket 517 have rotated outward toward the front lift tube 528. This forward position of the activator tube bracket 517 caused the lock 518 to be positioned such that the slot 518*d* of the lock 518 is no longer able to engage the member 538*a*, and thus, the lock 518 is in an unlocked position, thereby allowing the lift mechanism 500 to lift a chair.

When the extendable activator member 514 is retracted back from its position depicted in FIG. 14, which is associated with a chair in a reclined position, the activator tube 516 and activator tube bracket 517 would rotate back away from the front lift tube 528. The backward rotation would create a force on the lock connection point 518*c* so as to push the link 518*a* of the lock 518 rearward causing the link 518*b* of the lock 518 to pivot counterclockwise about the connection point 518*f*, which allows the slot 518*d* to engage the member 538*a*.

As discussed above with reference to the reclining mechanism 200 depicted in FIGS. 4-11, the activator tube bracket, e.g., the activator tube bracket 517, is coupled to the drive link, e.g., the drive link 631, so that when the activator tube bracket 517 moves and/or rotates, the drive link 631 also moves. This movement of the drive link 631 can activate or initiate the reclining mechanism to shift a chair from a reclined position to an upright, closed position. The lift mechanism 500 of FIG. 14 is configured such that when the activator tube bracket 517, and activator tube 516, are positioned to maintain the lock 518 in an unlocked position, the drive link 631 is positioned such that a reclining mechanism can be in the upright, closed position. Further, the lift mechanism 500 of FIG. 14 is configured such that when the activator tube bracket 517, and the activator tube 516, are positioned to maintain the lock 518 in the locked position, the drive link 631 is positioned such that the reclining mechanism can be in the reclined position. This coordinated fashion of the lift mechanism 500 (including the lock 518) and the drive link 631 ensures that a chair is in the upright, closed position prior to shifting the chair into a seat-lift position.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A lift mechanism for a seating unit comprising:

a lift activator assembly configured to shift a seating unit between a closed position and a seat-lift position, the lift activator assembly comprising an activator tube; and a lock configured to shift between a locked position, where the seating unit is prevented from shifting into the seat-lift position, and an unlocked position, where the seating unit is permitted to shift into the seat-lift position, wherein the activator tube is configured to shift the lock from the locked position to the unlocked position, and wherein the lock is configured to pivot about a fixed connection point when shifting between the locked position and the unlocked position.

2. The lift mechanism of claim 1, wherein the lift activator assembly further comprises an extendable activator member configured to extend outward toward the front of the seating unit, wherein the activator tube is configured to move when the extendable activator member extends outward.

3. The lift mechanism of claim 2, wherein, when the extendable activator member extends outward, the activator tube is configured to rotate about a fixed point upward and outward toward the front of the seating unit, thereby shifting the lock from the locked position to the unlocked position.

4. The lift mechanism of claim 3, wherein the lift activator assembly further comprises a swing link pivotably coupled to the extendable activator member and fixedly coupled to the activator tube.

5. The lift mechanism of claim 3, wherein, when the extendable activator member extends outward, the activator tube is configured to engage the lock to shift the lock between the locked position and the unlocked position.

6. The lift mechanism of claim 5, wherein, when the lock is in the unlocked position, the activator tube is in contact with the lock.

7. The lift mechanism of claim 1, wherein the lift mechanism further comprises a lower riser bar and at least one cross member extending out therefrom, wherein, when in the locked position, the lock engages the at least one cross member.

8. The lift mechanism of claim 7, wherein the lift mechanism further comprises one or more side lift plates, wherein the lock is pivotably coupled to at least a portion of a side lift plate of the one or more side lift plates, wherein a biasing member coupled to the lock is configured to bias the lock in the locked position.

9. A lift mechanism for a seating unit comprising:

a lift activator assembly configured to shift a seating unit between a closed position and a seat-lift position, the lift activator assembly comprising an extendable activator member and an activator tube; and a lock configured to pivotably shift between a locked position, where the seating unit is prevented from shifting into the seat-lift position, and an unlocked position, where the seating unit is permitted to shift into the seat-lift position, wherein the extendable activator member is configured to extend outward toward the front of the seating unit, wherein the activator tube is configured to shift the lock from the locked position to the unlocked position as the extendable activator member extends outward toward the front of the seating unit.

10. The lift mechanism of claim 9, wherein the lift activator assembly further comprises a swing link, wherein the swing link is pivotably coupled to the extendable activator member and fixedly coupled to the activator tube.

11. The lift mechanism of claim 10, wherein the lift mechanism further comprises a front lift tube, wherein the swing link is pivotably coupled to the front lift tube or pivotably coupled to a front lift tube bracket.

12. The lift mechanism of claim 9, wherein, when the extendable activator member extends outward, the activator tube is configured to rotate about a fixed point upward and outward toward the front of the seating unit, thereby shifting the lock from the locked position to the unlocked position.

13. The lift mechanism of claim 12, wherein the activator tube engages the lock to shift the lock between the locked position and the unlocked position.

14. The lift mechanism of claim 9, wherein the lift activator assembly and the lock are configured to cooperatively prevent the seating unit from shifting from a reclined position to the seat-lift position without first shifting from the reclined position to the closed position.

15. A lift chair comprising:

a seat;

a seat back;

a lift activator assembly configured to shift a chair between a closed position and a seat-lift position, the lift activator assembly comprising an activator tube; and a lock configured to shift between a locked position, where the seating unit is prevented from shifting into the seat-lift position, and an unlocked position, where the seating unit is permitted to shift into the seat-lift position, wherein the activator tube is configured to shift the lock from the locked position to the unlocked position, and wherein the lock is configured to pivot about a fixed connection point when shifting between the locked position and the unlocked position.

16. The lift chair of claim 15, wherein the lift activator assembly further comprises an extendable activator member configured to extend outward toward the front of the chair, wherein, when the extendable activator member extends outward, the activator tube is configured to rotate about a fixed point upward and outward toward the front of the seating unit, thereby shifting the lock from the locked position to the unlocked position.

17. The lift chair of claim 15, wherein the lift activator assembly and lock are configured to cooperatively prevent the seating unit from shifting from a reclined position to the seat-lift position without first shifting from the reclined position to the closed position.

* * * * *